US006389777B1

(12) United States Patent
Karlsson

(10) Patent No.: US 6,389,777 B1
(45) Date of Patent: May 21, 2002

(54) DEVICE AND METHOD FOR PROTECTING AN OBJECT

(75) Inventor: Åke Karlsson, Mölnlycke (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/333,882

(22) Filed: Jun. 15, 1999

(30) Foreign Application Priority Data

Jun. 16, 1998 (SE) ..... 9802143

(51) Int. Cl.[7] ..... E04G 21/24

(52) U.S. Cl. ..... 52/741.3; 52/736.4; 52/122.1; 52/722.1; 206/522; 206/321; 114/219

(58) Field of Search ..... 52/122.1, 741.3, 52/721.5, 723.2, 738.1, 736.4, 722.1, 2.13, 2.18, 2.19, 2.21, 2.22; 206/522, 321, 591; 441/67, 81, 88; 285/97, 96; 256/13.1, 19; 114/219

(56) References Cited

U.S. PATENT DOCUMENTS

| | | | | | |
|---|---|---|---|---|---|
| 1,140,358 | A | * | 5/1915 | Cleave | 441/81 |
| 2,732,864 | A | | 1/1956 | Stansbury | |
| 3,593,531 | A | * | 7/1971 | Saadeh | 114/219 X |
| 3,602,109 | A | * | 8/1971 | Harrington | 256/13.1 |
| 3,741,216 | A | * | 6/1973 | Yosowitz et al. | 128/346 |
| 3,803,651 | A | * | 4/1974 | Moore | 9/8 R |
| 3,858,613 | A | | 1/1975 | Musselwhite | |
| 3,992,735 | A | * | 11/1976 | McCarthy | 9/8 R |
| 4,868,967 | A | * | 9/1989 | Holt et al. | 206/328 X |
| 4,976,642 | A | * | 12/1990 | Wilkie | 441/81 X |
| 5,247,974 | A | * | 9/1993 | Sargent et al. | 285/97 X |
| 5,272,856 | A | | 12/1993 | Pharo | |
| 5,502,842 | A | * | 4/1996 | Wagner | 441/88 X |

FOREIGN PATENT DOCUMENTS

| | | |
|---|---|---|
| DE | 19618560 | 11/1997 |
| EP | 0317130 | 5/1989 |
| GB | 2174059 | 10/1986 |
| WO | WO8703270 | 6/1997 |

* cited by examiner

*Primary Examiner*—C Friedman
*Assistant Examiner*—Winne Yip
(74) *Attorney, Agent, or Firm*—Burns, Doane, Swecker & Mathis L.L.P.

(57) ABSTRACT

The present invention relates to a protective device (102) and to a method for protecting an object (101) against mechanical damage as it is lifted up or lowered down a vertically extending structure (103), such as the wall of a building or a mast for instance, and also for protecting the structure along which said object is moved. There is placed around the object at least one protective device (102) which includes a first inflatable tube that is fastened to a second inflatable tube. The tubes are positioned so as to form two concentrical rings or spirals around the object (101), with the first tube located inwardly of the second tube. The first tube is filled with a suitable amount of gas, preferably air, such as to bring the first tube into contact with the object (101) and therewith firmly hold the protective device (102) to the object (101) through the medium of frictional forces. The second tube is filled with a suitable amount of gas, preferably air, such that the second tube will act as a bumper or fender between the object and the wall.

15 Claims, 2 Drawing Sheets

DEVICE AND METHOD FOR PROTECTING AN OBJECT

This application claims priority under 35 U.S.C. §§119 and/or 365 to 9802143-9 filed in Sweden on Jun. 16, 1998; the entire content of which is hereby incorporated by reference.

FIELD OF INVENTION

The present invention relates to a device and to a method for protecting an object, and more specifically for protecting, for instance, an antenna or a microbase station from mechanical damage as the antenna or station is hoisted up or lowered down along a vertical structure, for instance a mast or the wall of a building.

DESCRIPTION OF THE BACKGROUND ART

Various types of objects are lifted up or lowered down along vertical structures, such as along masts or the walls of buildings for instance, in many different connections. One example in this respect is found in the installation and maintenance of base stations and antennas in mobile telephone networks. When hoisting and lowering equipment up and down masts, walls and other vertically extending structures in conjunction with either mounting or dismantling said equipment, there is a risk of mechanical damage being caused to the equipment itself, and also to objects such as windows, walls, etc., that are struck or scraped by the equipment as it is raised or lowered.

British Patent Application GB 2 174 059 describes a beer barrel provided with an inflatable barrel rolling ring for use in rolling the barrel, for instance when loading/unloading a brewery truck. The ring is fitted over the barrel with the ring deflated and is then inflated. The outer wall of the ring is comprised of a material that has a high coefficient of friction and, when inflated, the ring is held firmly to the barrel by the frictional forces acting between the barrel and the ring. The invention described in GB 2 174 059 is highly advantageous with respect to traditional beer barrels, since it enables the barrel to be given a simpler design and to be produced more cheaply, since it is unnecessary to pay the cost of repairing rolling rings that become damaged when handling the barrel, while the fact that the rolling ring can be removed when not needing to roll the barrel means that the barrel will take-up less space in a storeroom and on brewery trucks.

SUMMARY OF THE INVENTION

The present invention addresses the problem of protecting an object from mechanical damage, for instance radio equipment, as it is lifted up or lowered down a vertically extending structure, such as a mast or a wall for instance.

Another problem addressed by the invention is that of protecting the structure along which the object is moved from mechanical damage during the actual process of lifting or lowering the object.

These problems are solved generally in accordance with the invention with the aid of a method wherein the object is fitted with a protective device in the form of two inflatable tubes prior to moving object up or down the wall of a building. The protective device functions as a bumper or fender between object and wall as the object is raised or lowered. The invention relates both to a method for protecting the object and to the protective device. More specifically, the problems are solved by placing around the object at least one protective device which includes a first inflatable tube which is fastened to a second inflatable tube. The tubes are positioned so as to form two concentrical rings or spirals around the object, with the first tube located inwardly of the second tube. The first tube is filled with an appropriate amount of gas, preferably air, so as to be brought into contact with the object and to hold the protective device firmly to said object through the medium of frictional forces. The second tube is filled with an appropriate amount of gas, preferably air, such that the second tube will function as a fender or bumper between object and wall.

An object of the present invention is to provide a method and a device for protecting an object as it is lifted up or lowered down a vertically extending structure, such as the wall of a building or a mast, and also for protecting the structure along which the object is lifted or lowered from mechanical damage.

A further object of the invention is to provide a method of protecting the object and the structure along which the object is lifted or lowered that is flexible and can be readily put into effect.

One advantage afforded by the invention is that it affords a simple and flexible method of protecting an object as it is lifted up or lowered down a vertical structure, such as the wall of a building or a mast, and also of protecting the structure along which the object is raised or lowered from mechanical damage.

Another advantage afforded by the invention is that the use of an inner and an outer tube around the object enables the respective tubes to be optimised for the purpose of holding the device firmly to the object by friction and of acting as a bumper between said object and said structure.

A further advantage afforded by the invention is that the protective device will only take up a small amount of space when deflated, therewith enabling the device to be transported and stored easily and conveniently.

The invention will now be described in more detail with reference to preferred embodiments thereof and also with reference to the accompanying drawings.

DESCRIPTION OF PREFERRED EMBODIMENTS

Figure 1:
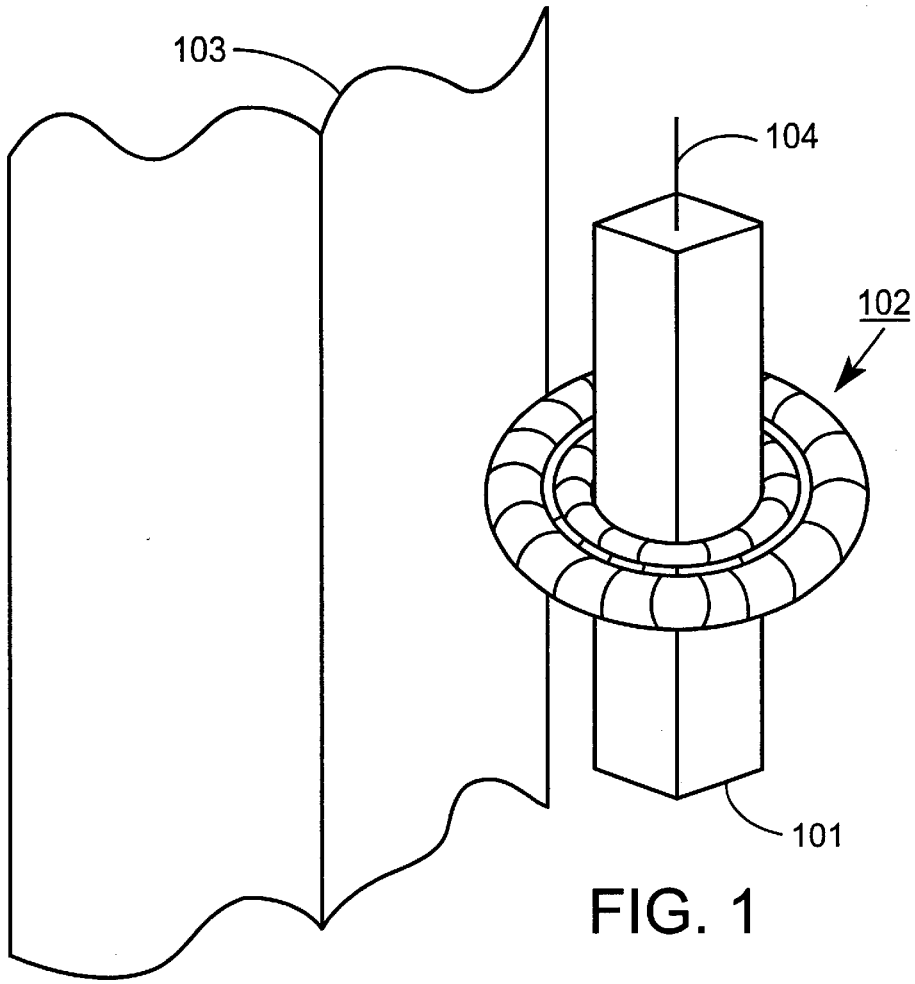
FIG. 1 is a view which illustrates the manner in which an object is lifted up along the wall of a building.

FIG. 1 illustrates an object 101, which may be an antenna for instance, fitted with an inventive protective device 102 and being lifted up along the wall 103 of a building. The object 101 fitted with the protective device 102 is raised along the wall 103 by means of a lifting line 104 connected to said object.

Figure 2A:
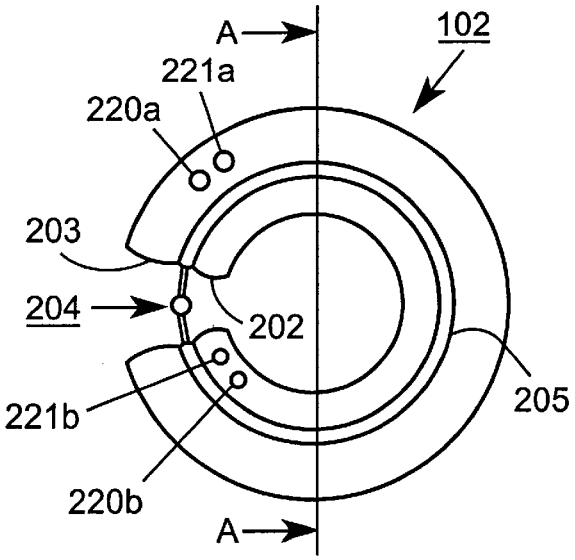
FIG. 2A is a general view illustrating a first embodiment of an inventive protective device.
Figure 2B:
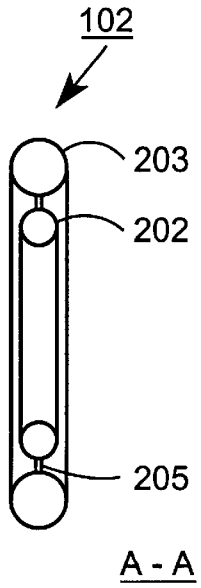
FIG. 2B is a sectioned view of the protective device illustrated in FIG. 2A.

FIGS. 2A and 2B illustrate a first embodiment of the protective device 102. The protective device 102 shown in FIG. 2A includes a first inflatable gastight tube 202 which is fastened to a second inflatable, gastight tube 203 by means of a tube-interconnecting piece 205. When the protective device 102 is fitted to the object 101, the two tubes 202–203 form two mutually concentrical rings around the object 101, with the first tube 202 located inwardly of the second tube 203. The device 102 also includes an openable or releasable locking means 204 which when the protective device 102 is fitted to the object 102 functions to hold the device 102 in the form of a coherent structure and therewith form a body which embraces the object 101.

Figure 3A:
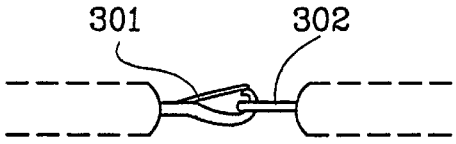
FIG. 3A illustrates a locking means which includes a snap-hook and an eyelet.
Figure 3B:
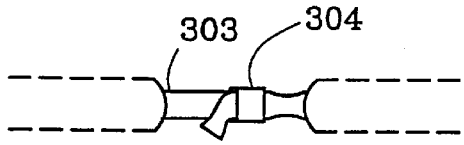
FIG. 3B illustrates a locking means which comprises a strap and a strap fastener.

FIG. 3A illustrates a first exemplifying embodiment of the locking or fastener means 204 in the form of a snap-hook 301 and an eyelet 302. FIG. 3B illustrates a second exemplifying embodiment of the locking or fastener means 204 in the form of a strap 303 and a strap fastener 304. The locking means 204 is conveniently fastened in the interconnecting piece 204 that holds the two tubes together, as shown in FIG. 2A.

When fitting the protective device 102 to the object 101, the device is positioned around the object with the locking means open, whereafter the locking means 204 is closed so as to hold the device around the object. The first tube 202 is filled with a suitable amount of gas, preferably air, such as to bring the first tube 202 into firm contact with the object 101 and to hold the device 102 firmly to the object 101 through the action of frictional forces. The second tube 203 is filled with gas, preferably air, and functions as a bumper or fender between the object 101 and the wall 203 as the object is moved along the wall, therewith protecting both the object 101 and the wall 103 against mechanical damage should the object 101 with the protective device 102 fitted thereto strike against or scrape along said wall 103.

FIG. 2B is a sectional view of the protective device 102, taken along the section line A—A in FIG. 2A. Each of the tubes 202, 203 is designed for its respective purpose. Thus, the first tube 202 is constructed to hold the protective device 102 firmly against the object 101 by frictional forces, whereas the second tube 203 is constructed to function as a bumper between the object 101 and the wall 103 of said building.

The measurements of the protective device are determined with respect to the geometry of the object to be protected. When the protective device is intended to protect an antenna, which is a typical example in this respect, the second tube 203 will preferably have an outer diameter of 1 m and a cross-section diameter of 200–250 mm when inflated, whereas an inflated first tube 202 may have a cross-section diameter of 150–200 mm.

The outer casing or wall of the first tube 202 will preferably be made of a material that has a high coefficient of friction, for instance some form of rubber mixture. As an alternative to constructing the outer casing of the first tube 203 totally from material that has a high coefficient of friction, the high friction material may be placed solely in those regions of said outer casing that are expected to come into contact with the object 101.

At least that part of the outer casing of the second tube 203 that comes into contact with the wall 103 is preferably made of a material that has a low coefficient of friction such that the protective device 102 will slide along the wall 103 as it comes into contact therewith. A suitable material in this respect is nylon fabric.

Each of the two tubes 202, 203 includes valves by means of which the tubes can be filled with and emptied of air independently of each other. The amount of air introduced into respective tubes 202, 203 is adapted to ensure optimum functioning of said tubes. The amount of air introduced into the first tube 202 is adapted so that the pressure exerted by the first tube 202 against the object 103 will generate sufficient frictional force to hold the protective device 102 firmly to the object 103 without damaging said object. Correspondingly, the amount of air introduced into the second tube 203 is adapted to ensure that the tube will optimally fulfil its bumper function.

The tubes are provided with respective air supply valves 220*a* and 220*b* and air release valves 221*a* and 221*b* for inflating and deflating the tubes. The valves are suitably designed so as to enable them to be manipulated by a person wearing gloves and without the use of a tool. One method of enabling different air-filling systems to be used, is to provide each tube with a plurality of air supply valves of different designs.

It will be understood that the invention is not restricted to the aforedescribed and illustrated embodiment thereof, and that a large number of alternative embodiments of an inventive protective device are conceivable.

Figure 4A:
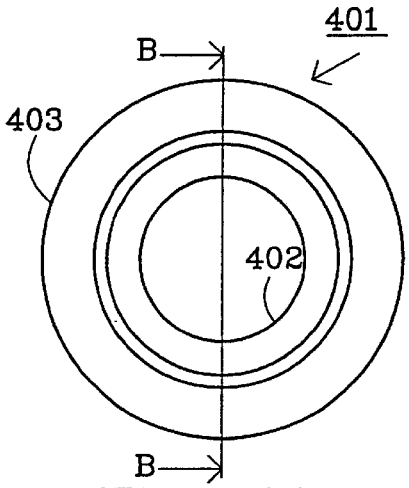
FIG. 4A is a general view illustrating a second embodiment of an inventive protective device.
Figure 4B:
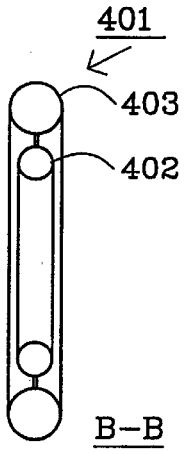
FIG. 4B is a sectioned view of the protective device illustrated in FIG. 4A.

FIGS. 4A–4B illustrate an example of a second embodiment of a protective device. In the case of the embodiment shown in FIG. 4A, the protective device 401 includes tubes 402, 403 which are closed rings instead of each having two ends as in the case of the embodiment illustrated in FIG. 2A.

FIG. 4B is a sectional view of the protective device 401 taken on the section line B—B in FIG. 4A.

A protective device 401 according to this embodiment, in which the two tubes 402, 403 have the form of closed rings, is fitted to the object to be protected by threading the device over said object. An advantage with this embodiment in relation to the embodiment illustrated in FIGS. 2A and 2B, is that no locking means is required.

It may be impossible or extremely difficult in some cases to thread a protective device over the object to be protected because of its shape, and consequently it may be necessary in these situations to use a protective device that includes an openable locking or fastening means which will allow the device to be folded around the object to be protected.

Figure 5A:
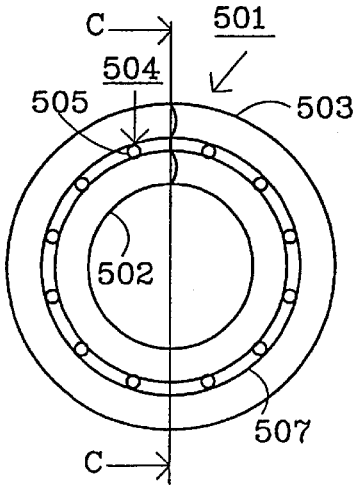
FIG. 5A is a general view of a third embodiment of an inventive protective device.
Figure 5B:
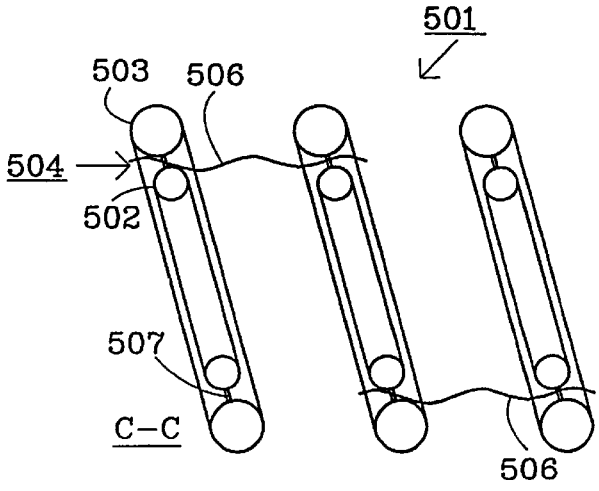
FIG. 5B is a sectioned view of the protective device illustrated in FIG. 5A.

FIGS. 5A and 5B illustrate a further example of an embodiment of a protective device 501. Similar to the first embodiment illustrated in FIGS. 2A and 2B, the protective device 501 illustrated in FIG. 5A includes a first inflatable gastight tube 502 which is fastened to a second inflatable, gastight 503 by means of an interconnecting piece 507. However, in the case of the FIG. 5 embodiment, the two tubes 502, 503 are adapted to form two concentrical spirals around the object to be protected, with the first tube 502 located inwardly of the second tube 503 when the protective device is mounted in position on said object.

FIG. 5B is a sectional view of the protective device 501 taken on the section line C—C in FIG. 5A and illustrates said concentric spirals.

The protective device 501 also includes a releasable locking means 504 which, when the protective device 501 is fitted on the object, functions to hold the protective device 502 together in the form of a unitary body, in this case a spiral body, which embraces the object. The first tube 502 and the second tube 503 have the same function as the first tube 202 and the second tube 203 in the protective device illustrated in FIGS. 2A and 2B.

In this case, the locking means 504 may include a plurality of through-penetrating holes 505 in the interconnecting piece 507 that holds the two tubes 502, 503 together. As shown in FIG. 5B, an undulating locking pin 506 provided at each end of the protective device is threaded through the very outermost hole and also through an appropriate hole in the next turn of the spiral. The pin is undulated so as to prevent it from sliding accidentally from any of the holes through which it is threaded.

As an alternative to an undulating locking pin according to FIG. 5, there may be used a straight pin that is provided with two stops for preventing unintentional sliding of the pin from any of the holes 504. At least one of the stops is removable, so as to enable the pin to be threaded through holes 504. The stops may either be seated at respective ends of the pin or at least one of the stops may be displaceable along said pin. The straight pin may either have a fixed length or may be constructed so that its length can be adjusted, for instance in a manner similar to that in which the length of the legs of a camera stand can be adjusted.

As an alternative to the locking pins described above and illustrated in FIG. 5, respective ends of the protective device can be secured against adjacent spiral turns with the aid of string or cord. The two ends of the protective device may also conceivably be mutually secured with the aid of a single line.

The protective device 501 illustrated in FIGS. 5A and 5B has the advantage of enabling one and the same protective device 501 to be used to protect different objects of varying measurements. In this regard, the number of turns or the number of part-turns of the concentrical spirals will depend on the external measurements of the object to be protected.

What is claimed is:

1. A protective device, in combination with an object for protecting the object whilst moving the object essentially vertically along a vertically extending structure, comprising:

a first inflatable, gastight tube which is attached to a second inflatable, gastight tube, wherein when the device is mounted on the object, the first and second tubes are disposed to form two concentrical rings adapted to encircle the object, with the first tube located inwardly of the second tube; whereas said first and second tube are attached by an tube interconnecting piece that is flat and concentric with the first and second tubes;

the first tube being filled with gas such as to bring the first tube into contact with the object and therewith adapted to attach the protective device to the object through the medium of frictional forces; in that the second tube being filled with gas to an extent such that the second tube functions as a bumper or fender between the object and the structure;

wherein the second tube is adapted to allow substantial relative movement with respect to the structure;

wherein each of the first and second tubes have two ends; and said ends also include a releasable lock or fastener for releasable connection such that when the protective device is fitted to the object, the lock or fastener functions to hold the protective device together in the form of a unitary body that embraces the object.

2. A protective device according to claim 1, wherein the material in the outer casing of the first tube which is adapted to contact said object has a higher coefficient of friction than the material in the outer casing of that part of the second tube which is adapted to come into contact with said structure as said object is moved.

3. A protective device according to claim 1, wherein at least one of the first and second tubes includes at least two air supply valves of mutually different construction.

4. A protective device according to claim 1, wherein the second tube has a cross-section diameter that is a minimum of 200 millimeters and the first tube has a cross-section diameter that is a minimum of 150 millimeters.

5. A protective device, in combination with an object for protecting the object whilst moving the object essentially vertically along a vertically extending structure, comprising:

a first inflatable, gastight tube to a second inflatable, gastight tube by an interconnecting piece, wherein when the protective device is mounted on said object, the first and second tubes form two concentrical spirals adapted to encircle said object, with the Spiral of the first tube located inwardly of the second tube;

the first tube being filled with gas to an extent such as to bring the first tube into contact with said object and therewith adapted to attach the protective device to the object through the medium of frictional forces;

the second tube being filled with gas such that said second tube functions as a bumper or fender between the object and the structure; wherein each of the first and second tubes have first and second ends.

6. A protective device according to claim 5, wherein and in that the device also includes a releasable lock or fastener which, when the protective device is fitted to the object, functions to hold the protective device together in the form of a unitary body that embraces the object.

7. A protective device according to claim 5, wherein the material in the outer casing of the first tube which is adapted to contact said object has a higher coefficient of friction than the material in the outer casing of that part of the second tube which is adapted, to come into contact with said structure as said object is moved.

8. A protective device according to claim 5, wherein at least one of the first and second tubes includes at least two air supply valves of mutually different construction.

9. A protective device according to claim 5, wherein the second tube has a cross-section diameter that is a minimum of 200 millimeters and the first tube has a cross-section diameter that is a minimum of 150 millimeters.

10. A protective device according to claim 5, wherein the second tube is adapted to allow substantial relative movement with respect to the structure.

11. A method of protecting an object as it is moved essentially vertically along a vertically extending structure, comprising:

a) encircling the object with at least one protective device that includes a first gastight tube and a second gastight tube such that the first and second tubes form two concentrical rings encircling said object, with the first tube located inwardly of the second tube;

b) filling the first tube with a suitable amount of gas such as to bring the first tube into contact with the object so as to attach the protective device to said object through the medium of frictional forces; and c) filling the second tube with a suitable amount of gas such that the said second tube functions as a bumper or fender between the object and the structure along which the object is moved.

12. A method according to claim 11, wherein the first and second tubes have the form of closed rings, and that step a) involves threading the protective device over and around the object.

13. A method according to claim 11, wherein each of the first and second tubes has two ends; in that the protective device also includes a releasable locking means; and in that step a) involves folding the protective device around the object with the locking means released, and thereafter securing the locking means so as to hold the protective device together around said object.

14. A method of protecting an object as it is moved essentially vertically along a vertically extending structure, comprising:

a) encircling the object with at least one protective device that includes a first gastight tube and a second gastight tube, such that the first and second tubes form two concentrical spirals encircling said object with the first tube located inwardly of the second tube;

b) filling the first tube with a suitable amount of gas such as to bring the first tube into contact with the object so as to attach the protective device to the object through the medium of frictional forces; and c) filling the second tube with a suitable amount of gas such that said second tube will function as a bumper or fender between the object and the structure along which the object is moved.

15. A method according to claim 14, wherein each of the first and second tubes has two ends; in that the protective device also includes a releasable locking means; and in that step a) involves folding the protective device around the object with the locking means released, and thereafter securing the locking means so as to hold the protective device together around said object.

* * * * *